US007004818B1

(12) United States Patent
Haney

(10) Patent No.: US 7,004,818 B1
(45) **Date of Patent: *Feb. 28, 2006**

(54) SANDER WITH ORBITING PLATEN AND ABRASIVE

(76) Inventor: Donald E. Haney, 11376 Ramsey Rd., Gold Mill, OR (US) 97525

( * ) Notice: Subject to any disclaimer, the term of this patent is extended or adjusted under 35 U.S.C. 154(b) by 0 days.

This patent is subject to a terminal disclaimer.

(21) Appl. No.: 08/993,699

(22) Filed: Dec. 18, 1997

Related U.S. Application Data

(60) Continuation of application No. 08/477,069, filed on Jun. 7, 1995, now Pat. No. 5,702,287, which is a continuation of application No. 08/260,360, filed on Jun. 15, 1994, now Pat. No. 5,443,414, which is a continuation of application No. 08/006,379, filed on Jan. 19, 1993, now Pat. No. 5,321,913, which is a continuation of application No. 07/787,897, filed on Nov. 5, 1991, now Pat. No. 5,181,342, which is a division of application No. 07/568,902, filed on Aug. 17, 1990, now Pat. No. 5,081,794.

(51) Int. Cl.
*B24B 7/06* (2006.01)
*B24B 7/02* (2006.01)

(52) U.S. Cl. ..... 451/28; 451/167; 451/157

(58) Field of Classification Search ..... 451/57, 451/67, 166, 167, 162, 159, 158, 261, 270, 451/271, 282, 357, 356, 28, 130
See application file for complete search history.

(56) References Cited

U.S. PATENT DOCUMENTS

| | | | |
|---|---|---|---|
| 67,240 | A | 7/1867 | Weissenborn |
| 296,585 | A | 4/1884 | Laughton |
| 346,680 | A | 8/1886 | Perry |

(Continued)

FOREIGN PATENT DOCUMENTS

| | | |
|---|---|---|
| AT | 75240 | 1/1919 |
| CZ | 12819 | 5/1924 |
| CZ | 15597 | 5/1925 |
| CZ | 26494 | 10/1928 |
| CZ | 63664 | 2/1939 |

(Continued)

OTHER PUBLICATIONS

Abrasive, Orbital Sander Improve Finish Sand Quality, Wood Digest, 6/90.

Tilleke Maschinenbau publication, undated.

Tilleke De–Nibbing Machine publication, undated.

(Continued)

*Primary Examiner*—Robert A. Rose
(74) *Attorney, Agent, or Firm*—Kolisch Hartwell, P.C.

(57) ABSTRACT

The invented Sander with Orbiting Platen and Abrasive includes a platen, an abrasive secured to the platen, and a motor connected to the platen to move the platen and abrasive in an orbit or circular pattern The motor is connected to the platen by a belt that extends around at least one drive shaft, where the shaft includes two ends with a step between the ends so that when the shaft is rotated around one end's longitudinal axis, the step causes a portion of the shaft and the platen to orbit around that axis. The preferred embodiment of the invented sander includes a frame, a conveyor, first and second drive shafts that support a brace and that cause the brace to move in a first orbit, second and third drive shafts that are supported by the brace and connected to an orbit so that when the second and third drive shafts are rotated, the platen moves in a second orbit, and a plurality of rubber or synthetic rubber stabilizers positioned between the brace and platen. In the invented sander the conveyor feeds a product toward the platen and a rotating brush abrades and polishes the product after it has been sanded by the platen.

6 Claims, 5 Drawing Sheets

U.S. PATENT DOCUMENTS 449,686 A 4/1891 Malevez
496,052 A 4/1893 Friedel
513,618 A 1/1894 Oppermann
577,582 A 2/1897 Lane et al.
676,487 A 6/1901 Brown
714,899 A 12/1902 Hayes
1,027,558 A 5/1912 Meyers
1,143,725 A 6/1915 Reed
1,166,640 A 1/1916 Shaw
1,233,120 A 7/1917 Patch
1,494,895 A 5/1924 Foldessy
1,909,902 A 5/1933 Amsler
1,962,766 A 6/1934 Crowley et al.
1,962,767 A 6/1934 Crowley et al.
1,963,357 A 6/1934 Filley
1,988,577 A 1/1935 Scrimgeour
2,192,486 A 3/1940 Lockhart
2,195,065 A 3/1940 Wallace
2,234,109 A 3/1941 Culpepper
2,269,197 A 1/1942 Hamilton
2,286,208 A 6/1942 Kirchner
2,294,064 A 8/1942 Amstuz
2,311,346 A 2/1943 Munn
2,405,328 A 8/1946 Robinson, Jr.
2,412,141 A 12/1946 Ford
2,442,042 A 5/1948 Hamilton
2,447,102 A 8/1948 Strand
2,485,295 A 10/1949 Larson
2,553,254 A 5/1951 Hays
2,579,866 A 12/1951 Rosseau
2,606,947 A 8/1952 Happe
2,641,878 A 6/1953 Radabaugh
2,644,280 A 7/1953 O'Neil, Jr.
2,690,036 A 9/1954 Baldridge
2,700,259 A 1/1955 Dreyfus
2,729,037 A 1/1956 Soccoli
2,751,725 A 6/1956 Champayne
2,787,100 A 4/1957 Peyches
2,842,904 A 7/1958 Ralys
2,843,980 A 7/1958 Bernstein et al.
2,909,871 A 10/1959 Heymes et al.
2,926,465 A 3/1960 Sommers
2,945,330 A 7/1960 Peyches
2,949,707 A 8/1960 Weesner
2,984,051 A 5/1961 Monnet et al.
2,985,989 A 5/1961 Knost
2,989,823 A 6/1961 Bernstein
3,006,116 A 10/1961 Knost
3,026,653 A 3/1962 De Zordo
3,079,734 A 3/1963 Eschenburg
3,094,815 A 6/1963 Pendergast
3,104,503 A 9/1963 Yelpo et al.
3,106,806 A 10/1963 Hutchins
3,107,456 A 10/1963 Walters et al.
3,203,074 A 8/1965 Monaghan
3,263,376 A 8/1966 Walters et al.
3,267,623 A 8/1966 Block
3,271,909 A 9/1966 Rutt et al.
3,339,319 A 9/1967 Schuster et al.
3,353,304 A 11/1967 Chaumont
3,400,501 A 9/1968 Chaumont
3,416,261 A 12/1968 Sherman et al.
3,522,680 A 8/1970 Sarofeen
3,533,193 A 10/1970 Dudek et al.
3,543,449 A 12/1970 Scott et al.
3,608,245 A 9/1971 Fair, Jr. et al.
3,654,738 A 4/1972 Sternal
3,701,219 A 10/1972 Sternal
3,704,559 A 12/1972 Morgan
3,708,817 A 1/1973 Rhine et al.
3,734,700 A 5/1973 Gutierrez et al.
3,754,354 A 8/1973 Franlinna
3,832,807 A 9/1974 Kiser et al.
3,844,069 A 10/1974 Shank
3,847,271 A 11/1974 Culley, Jr.
3,857,206 A 12/1974 Heffran, Jr.
3,859,758 A 1/1975 Fair, Jr.
3,892,091 A 7/1975 Hutchins
3,893,265 A 7/1975 Elm et al.
3,895,462 A 7/1975 Garin
3,906,678 A 9/1975 Roth
4,277,915 A 7/1981 Hausermann et al.
4,343,113 A 8/1982 van der Linden
4,375,738 A 3/1983 Bando
4,399,637 A 8/1983 Steinback
4,475,317 A 10/1984 Dicke
4,505,071 A 3/1985 Schwar
4,615,146 A 10/1986 Tassoni
4,622,783 A 11/1986 Konig et al.
4,627,195 A 12/1986 Greenleaf
4,635,405 A 1/1987 Stump
4,646,473 A 3/1987 Hundebol
4,651,474 A 3/1987 David
4,656,788 A 4/1987 Rhoades et al.
4,667,447 A 5/1987 Barton
4,720,940 A 1/1988 Green
4,733,500 A 3/1988 David
4,742,650 A 5/1988 Sauder, Jr. et al.
4,754,575 A 7/1988 Schneider
4,759,152 A 7/1988 Berger et al.
4,787,178 A 11/1988 Morgan et al.
4,788,798 A 12/1988 DeFranco et al.
4,798,025 A 1/1989 Lokken et al.
4,833,832 A 5/1989 Lindsey et al.
4,837,984 A 6/1989 David
4,845,898 A 7/1989 Preis
4,864,775 A 9/1989 David
4,878,317 A 11/1989 Ovens
4,891,916 A 1/1990 Rhoades et al.
4,969,296 A 11/1990 Seki et al.
5,018,314 A 5/1991 Fushiya et al.
5,170,588 A 12/1992 Schaal et al.
5,321,913 A * 6/1994 Haney ..... 451/166
5,443,414 A * 8/1995 Haney ..... 451/166
5,702,287 A * 12/1997 Haney ..... 451/28

FOREIGN PATENT DOCUMENTS

CZ 97265 11/1960
CZ 100056 6/1961
CZ 105088 4/1962
CZ 105532 9/1962
CZ 191037 4/1984
DE 186965 2/1905
DE 1556287 3/1972
DE 2740696 3/1979
DE 1938477 10/1980
DE 8808679 1/1988
DE 8912042.6 1/1990
DE 41420 7/2000
EP 0 117 585 9/1984
FR 567783 3/1924
FR 597948 12/1925
FR 1085718 2/1955
FR 7622105 1/1979
FR 8008410 10/1981
FR 8409613 1/1985
IT 789444 10/1967
JP 58-41084 7/1981
JP 62-297066 6/1986
NL 8802627 5/1990
SE 120348 12/1947

| | | |
|---|---|---|
| SU | 158815 | 11/1963 |
| SU | 178476 | 3/1966 |
| SU | 222894 | 10/1968 |
| SU | 334040 | 4/1972 |
| SU | 351679 | 12/1972 |
| SU | 905004 | 2/1982 |
| SU | 1138297 | 8/1983 |
| SU | 1242339 | 7/1986 |
| SU | 143370 | 10/1986 |
| SU | 1546236 | 8/1987 |
| SU | 1569190 | 2/1988 |

OTHER PUBLICATIONS

Solimaq Sanding and Brushing Machine publication, undated.

Lexicon of Production Engineering and Process Machines, vol. 9, Excerpt from p. 263, col. 2, section heading: "Grinding Tool," ©Deutsche Verlags–Anstalt GmbH, Stuttgart.

"Advanced Technology in Surface Finishing," The Finnishing Processes, *Manufacturing Engineering*, pp. 46–48, Dec. 1982.

Drawings produced by defendants in *Haney v. Ttimesavers, Inc.*, Civil No. 93–151–HA (D. Or.).

Feb. 14, 1996 letter from David Fanning to Mark Levine.

Feb. 21, 1996 letter from Mark Levine to David Fanning.

Declaration of Paul S. Petersen in Support of Timesavers' Motion for Summary Judgment of Non–Infringement, *Haney v. Timesavers*, Case No. CV–92–270–FR (D. Or. Mar. 25, 1993).

Amended Opinion, *Haney v. Timesavers*, Case No. CV–92–270–FR (D. Or. Oct. 13, 1993).

Declaration of Paul S. Petersen in Support of Timesavers' Motion for Summary Judgment of Non–Infringement, *Haney v. Timesavers*, Case No. CV–93–151–FR (D. Or. Oct. 29, 1993).

Opinion, *Haney v. Timesavers*, Case No. CV–93–151–FR (D. Or. Mar. 2, 1994).

Brief of Appellees, cover p. and pp. 24–26, *Haney v. Timesavers*, 94–1287 (Fed. Cir. Jul. 22, 1994) (prepared by attorneys for defendants–appellees).

Appeal Decision, *Haney v. Timesavers*, Appeal No. 94–1287 (Fed. Cir. Feb. 10, 1995).

Orders and Opinion, *Haney v. Timesavers*, Case No. CV–94–804–HA (D. Or. Apr. 26, 1995).

Supplemental Declaration of Richard W. Seed In Support of Timesavers' Second Brief on Summary Judgment Issues, *Haney v. Timesavers*, Case No. CV–93–151–FR (Lead, Consolidated Cases) (D. Or. Jun. 29, 1995).

Timesavers' Second Brief on Summary Judgment Issues: In Opposition to Haney's Motions for Summary Judgment . . . , *Haney v. Timesavers*, Case No. CV–93–151–FR (Lead, Consolidated Cases) (D. Or. Jun. 30, 1995).

Supplemental Declaration of Paul S. Petersen in Support of Timesavers' Second Brief on Summary Judgment Issues, *Haney v. Timesavers*, Case No. CV–93–151–FR (Lead, Consolidated Cases) (D. Or. Jun. 30, 1995).

Timesavers' Memorandum in Response to Haney's Motion for Partial Summary Judgment . . . , *Haney v. Timesavers*, Case No. CV–93–151–FR (Lead, Consolidated Cases) (D. Or. Aug. 15, 1995).

Opinion and Order, *Haney v. Timesavers*, Case No. CV–93–151–FR (Lead, Consolidated Cases) (D. Or. Oct. 13, 1995).

Order and Opinion, *Haney v. Timesavers*, Case No. CV–93–151–FR (Lead, Consolidated Cases) (D. Or. Oct. 19, 1995).

Declaration of Richard W. Seed in Support of Timesavers' Motion for Summary Judgment . . . , *Haney v. Timesavers*, Case No. CV–93–151–FR.

Declaration of Richard W. Seed in Support of Timesavers' Motion for Summary Judgment . . . (Corrected), *Haney v. Timesavers*, Case No. CV–93–151–FR.

Declaration of Richard W. Seed in Support of Timesavers' Motion for Summary Judgment . . . , *Haney v. Timesavers*, Case No. CV–93–151–FR.

Declaration of Paul S. Petersen in Support of Timesavers' Motion for Summary Judgment . . . , *Haney v. Timesavers*, Case No. CV–93–151–FR.

Declaration of Thomas W. Butler, Ph.D., *Haney v. Timesavers*, Case No. 93–151–FR (Lead), Aug. 14, 1997.

Supplemental Report of Thomas W. Butler, Ph.D., *Haney v. Timesavers*, Case No. 93–151–FR (Lead), Nov. 11, 1997.

Verdict Form, *Haney v. Timesavers*, Case No. 92–270–HA, Jan. 26, 1998.

Final Judgment, *Haney v. Timesavers*, Case No. 93–151–HA (Lead), Apr. 7, 1998.

* cited by examiner

SANDER WITH ORBITING PLATEN AND ABRASIVE

CROSS-REFERENCE TO RELATED APPLICATIONS

This is a continuation of application Ser. No. 08/477,069 filed Jun. 7, 1995, now issued as U.S. Pat. No. 5,702,287 on Dec. 30, 1997, which is a continuation of application Ser. No. 08/260,360 filed Jun. 15, 1994, now issued as U.S. Pat. No. 5,443,414 on Aug. 22, 1995, which is a continuation of Ser. No. 08/006,379 filed Jan. 19, 1993, now issued as U.S. Pat. No. 5,321,913 on Jun. 21, 1994, which is a continuation of application Ser. No. 07/787,897 filed Nov. 5, 1991, now issued as U.S. Pat. No. 5,181,342 on Jan. 26, 1993, which is a divisional continuation of application Ser. No. 07/568,902 filed Aug. 17, 1990, now issued as U.S. Pat. No. 5,081,794 on Jan. 21, 1992.

TECHNICAL FIELD

This invention relates to a sanding machine and more particularly to a finishing sander with an orbiting platen and abrasive.

BACKGROUND ART

A sander is a machine that uses an abrasive such as sandpaper to smooth or polish wood. Typically, the abrasive is moved back and forth across the product, abrading its surface and thereby smoothing it. Different abrasives can be used to achieve different results. For example, a coarse grit abrasive is used to abrade quickly and deeply. A fine grit abrasive is used to produce the final, desired smoothness.

However, even sanding machines that use a fine grit abrasive can leave sanding patterns in the product. A sanding pattern is simply a collection of scratches in the product's surface. For wood products, cross-grain sanding patterns, or scratches running across the wood's grain can result. To remove sanding patterns, finish sanding is often done by hand with a hand-held sander or with steel wool.

The invented sander provides an alternative to hand-held finishing sanders while removing sanding patterns. In other words, the invented sander eliminates the need for finish sanding to be done by hand.

DISCLOSURE OF THE INVENTION

The invented Sander with Orbiting Platen and Abrasive includes a platen, an abrasive secured to the platen, and a motor connected to the platen to move the platen and abrasive in an orbit or circular pattern. The motor is connected to the platen by a belt that extends around at least one drive shaft, where the shaft includes two ends with a step between the ends so that when the shaft is rotated around one end's longitudinal axis, the step causes a portion of the shaft and the platen to orbit around that axis. The preferred embodiment of the invented sander includes a frame, a conveyor, first and second drive shafts that support a brace and that cause the brace to move in a first orbit, second and third drive shafts that are supported by the brace and connected to a platen so that when the second and third drive shafts are rotated, the platen moves in a second orbit, and a plurality of rubber or synthetic rubber stabilizers positioned between the brace and platen. The invented sander also includes a conveyor to feed a product toward the platen and a rotating brush to abrade and polish the product after it has been sanded by the platen.

A product placed on the conveyor is fed toward the abrasive and platen, both of which are moving in a dual orbit. The first orbit is a high speed circular motion. As stated, the abrasive and platen are supported by a brace and the brace, platen and abrasive are all moved in a second orbit. The second orbit is also circular but at a much lower speed. The combination of the motions of the first orbit and the second orbit generally results in a single point on the abrasive and platen moving to produce a contact pattern on the product that includes a series of loops extending generally back and forth across a portion of the product surface and extending generally along the product surface in the conveyor feed direction.

Because of the orbiting movement of the abrasive and platen, virtually all sanding patterns are removed from the product. For hard surfaces or to remove deep scratches, the product may be fed through the machine multiple times. The product is then directed toward a rotating brush which removes any remaining surface scratches or sanding patterns.

DETAILED DESCRIPTION AND BEST MODE FOR CARRYING OUT THE INVENTION

Figure 1:
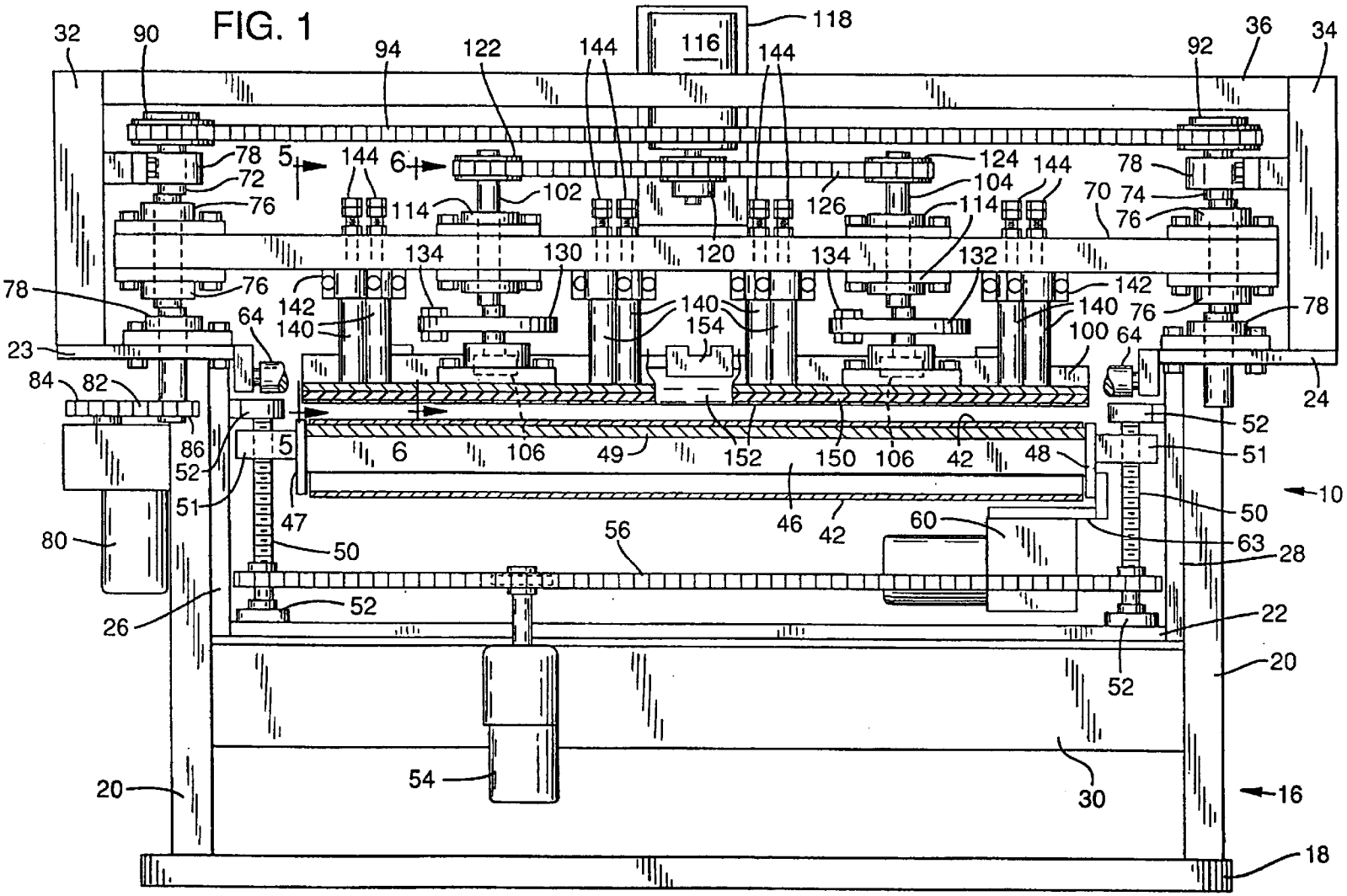
FIG. 1 is a front elevational view of the preferred embodiment of the invention.

The invented sander is shown generally at 10 in FIGS. 1–4. Sander 10 is housed in a protective casing 12 and it is controlled by a control panel 14, both of which are shown in dashed lines in FIG. 2. Casing 12 may be removed to allow for maintenance and repair of the invented sander. Casing 12 may also include ports or apertures to access the enclosed structure.

Inside of casing 12 the invented sander is supported by a frame 16, including a horizontal base support 18 and a plurality of vertical supports 20. In the embodiment shown in the drawings, there are three vertical supports 20 on each side of the sander.

Frame 16 also includes horizontal support plates 22, 23 and 24. Plates 22 and 23 are connected by vertical support plate 26 and plates 22 and 24 are connected by vertical support plate 28. Plates 26 and 28 are, in turn, connected to vertical supports 20 on their respective sides of the sander. A cross support 30 extends from one side of the sander to the other and connects two of the vertical supports 20.

Mounted to horizontal support plates 23 and 24, respectively, are two additional vertical supports 32 and 34. Supports 32 and 34 are positioned one on each side of the sander. Extending across the sander between supports 32 and 34 is a horizontal beam 36.

The above-described pieces of frame 16 may be welded together or joined by any known means. Of course, variations and modifications may be made to the frame depending on the desired size and configuration of the sander.

The invented sander also includes a conveyor belt assembly 40, including a conveyor belt 42 extending around rollers 44 and 46. The rollers are connected on one side by support 47 and on the other side by support 48. A plate 49, connected to supports 47 and 48, extends between rollers 44 and 46 and under the top surface of belt 42 to support the belt.

Supports 47 and 48 are mounted to screws 50 by threaded couplings 51. Screws 50 are mounted to frame 16 by bearings 52 which allow the screws to rotate. The screws are rotated by a motor 54 and a chain 56 driven by the motor which extends around toothed pulleys attached to the screws. By turning the screws 50, the conveyor belt assembly can be raised or lowered to any desired position. Alternatively, a hand operated mechanism may be used to raise and lower the conveyor assembly.

Figure 2:
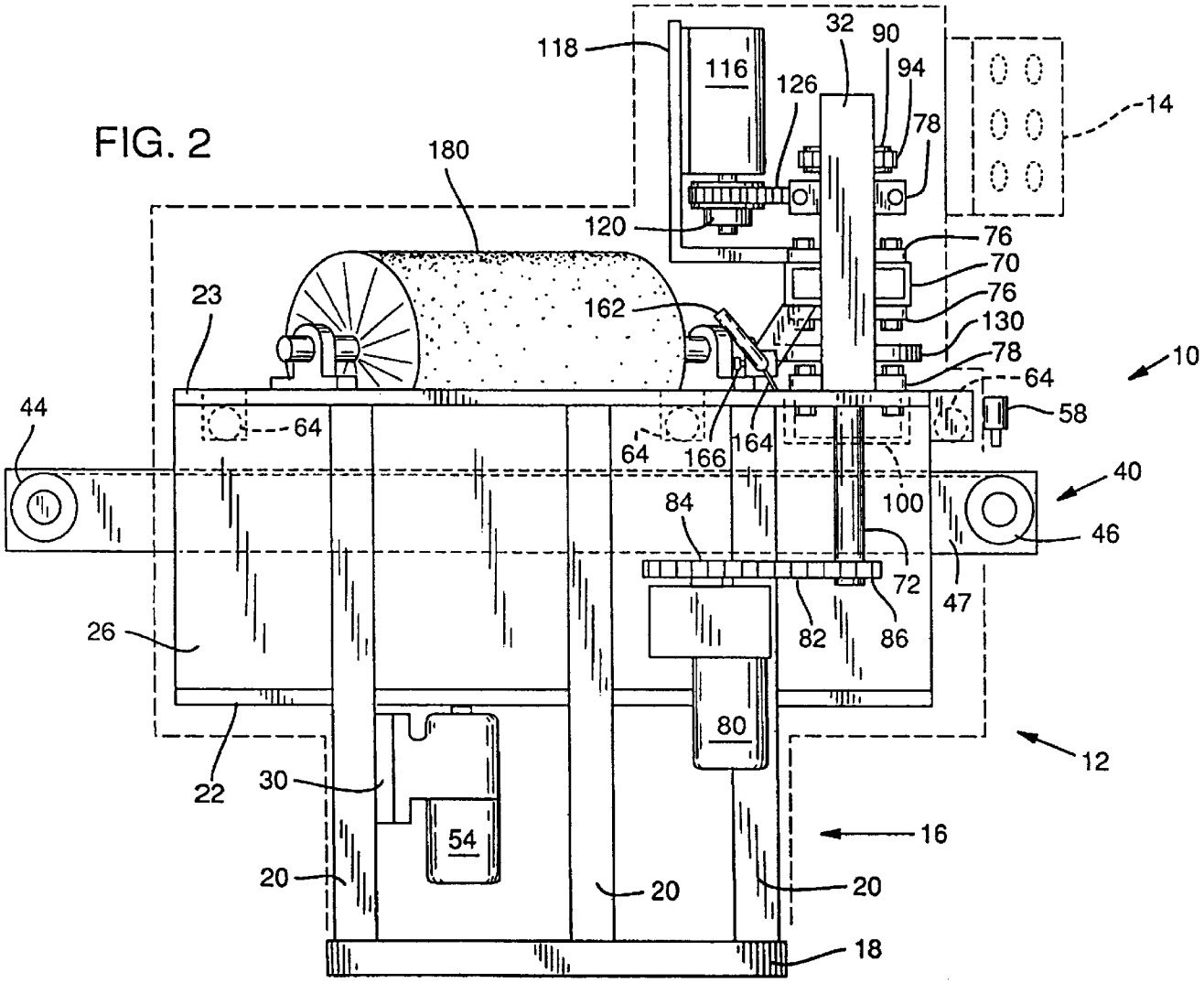
FIG. 2 is a side elevational view of the preferred embodiment of the invention.
Figure 3:
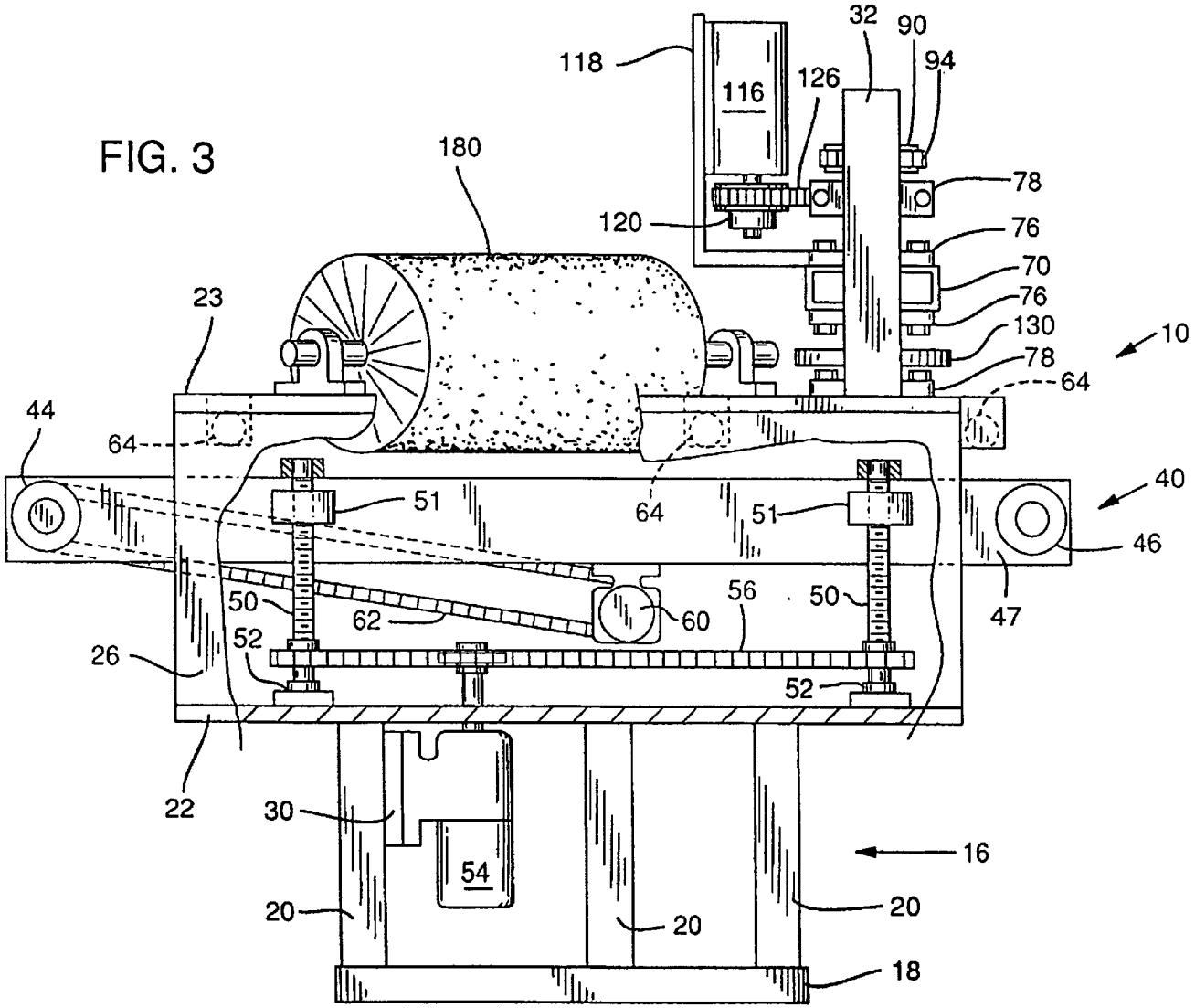
FIG. 3 is a view of the preferred embodiment of the invention similar to FIG. 2 but with parts of the invention broken away to show additional detail.

A gauge 58, shown attached to casing 12 in FIG. 2, is used to indicate the elevation or height of a product placed on the conveyor belt. For example, a wood product, such as a cabinet panel, is placed on the conveyor belt when it is lowered. Rotating screws 50 causes the conveyor belt and the panel to rise and contact the gauge which indicates when the conveyor and panel have reached the desired position. Gauge 58 may simply be an analogue dial with a spring-biased point that is pushed up when the conveyor belt assembly and wood panel is raised.

Conveyor belt 42 is powered by roller 44, which in turn is rotated by a motor 60 and a chain 62 extending between the motor and the roller. Motor 60 is mounted to support 48 of the conveyor belt assembly by a mount 63. Thus, motor 60 and chain 62 rise and lower with the conveyor belt when the belt assembly is raised and lowered. Idler or tensioning gears (not shown) may be positioned between motor 60 and roller 44 to maintain the appropriate tension on chain 62. Alternatively, a belt can be used to drive roller 44. Opposed and driven pinch rollers can also be used instead of a conveyor belt. For small applications, stationary guides can be used to hand feed the invented sander. "Conveyor means" is used herein to describe all these structures.

Positioned above the conveyor belt assembly, and mounted to the frame, are several pinch rollers 64. Products placed on conveyor belt 42 are held in place by pinch rollers 64 as they are fed through the invented sander.

Figure 8:
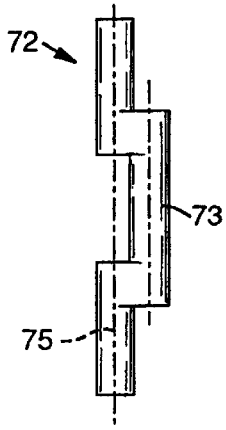

The invented sander also includes a brace 70, shown best in FIG. 1. Brace 70 is connected to two drive shafts 72 and 74. Drive shaft 72 is shown isolated from other structure in FIG. 8. As can be seen, shaft 72 includes a step portion 73 that extends away from and then returns to the longitudinal axis 75 of the shaft. When shaft 72 is rotated around axis 75, section 73 orbits around the axis. In the preferred embodiment, the step in shaft 72 is 5/32nds-of-an-inch, creating an orbit with a diameter of 5/16ths-of-an-inch. Shaft 74 is similar to shaft 72 and brace 70 is mounted to the two shafts around the shafts' stepped portions. Thus, when the shafts are rotated, their stepped portions as well as brace 70 move in an orbit.

Eccentric cams may be used instead of stepped drive shafts 72 and 74.

Brace 70 is mounted to shaft 72 by bearings 76 bolted to the brace. Shaft 72 is mounted to frame 16 by bearings 78 connected to plate 23 and support 32, as shown in FIG. 1. Shaft 74 is mounted to plate 24 and support 34 in a similar fashion.

A motor 80, mounted to one of the vertical supports 20, rotates shaft 72 by a chain 82 extending around a pulley 84 mounted to the motor's drive shaft and a pulley 86 mounted to the lower end of shaft 72. A pulley 90 is mounted to the upper end of shaft 72 and a similar pulley 92 is mounted to shaft 74. A chain 94 extends around pulleys 90 and 92 and an idler or tensioning gear 96 (shown in FIG. 4 only) maintains tension in the chain. Motor 80 rotates shaft 72 which in turn rotates shaft 74 by chain 94 extending around pulleys 90 and 92. As stated, rotating shafts 72 and 74 causes brace 70 to move in an orbit or circular pattern.

Figure 5:
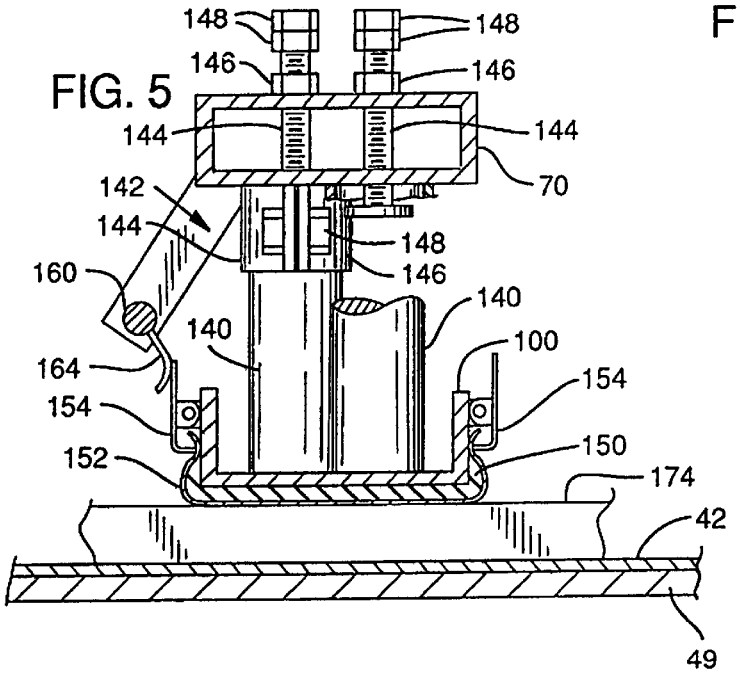
FIG. 5 is a simplified sectional view taken along the line 5—5 in FIG. 1.
Figure 6:
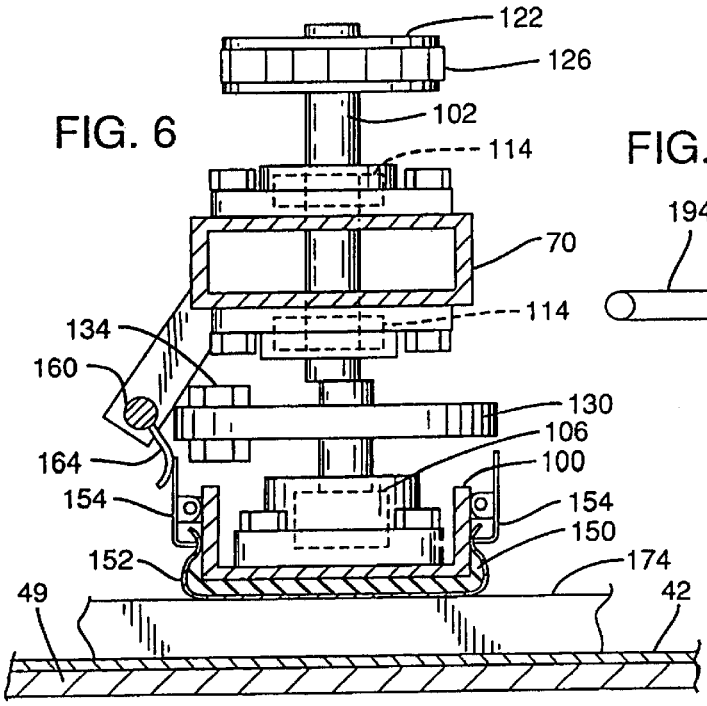
FIG. 6 is a simplified sectional view taken along the line 6—6 in FIG. 1.

The invented sander also includes an orbiting platen 100 shown best in FIGS. 1, 5 and 6. The platen is typically made of aluminum and, as seen in FIGS. 5 and 6, is generally U-shaped. The platen can be of varying widths and lengths. In the preferred embodiment, for example, its length ranges from 24-inches to 49-inches. Platen 100 is connected to two drive shafts 102 and 104 by standard flange mount bearings 106 which are bolted to the platen.

The use of standard flange mount bearings allows for self-alignment of the shafts when they are rotated. The invented sander can be constructed with only one shaft supporting the platen but the use of two or more shafts results in greater platen stability. Eccentric cams can be used instead of shafts 102 and 104.

Figure 7:
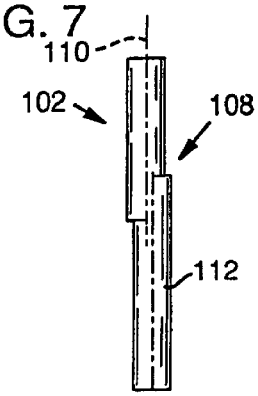
FIGS. 7 and 8 are simplified views of the drive shafts used in the preferred embodiment of the invention.

Shaft 102 is shown in FIG. 7 isolated from other structure. As can be seen in FIG. 7, shaft 102 includes a step 108 that extends away from the longitudinal axis 110 of the shaft. Step 108 causes a portion 112 of shaft 102 to orbit around the shaft's longitudinal axis when the shaft is rotated. In the preferred embodiment, step 108 is 1/16th-of-an-inch, resulting in an orbit having a diameter of 1/8th-of-an-inch. Shaft 104 is identical to shaft 102. Shafts 102 and 104 are connected to brace 70 by bearings 114.

A motor 116 is also connected to brace 70 by a mount 118. A timing pulley 120 is mounted to the drive shaft of the engine, a similar timing pulley 122 is mounted to the upper end of shaft 102 and a timing pulley 124 is mounted to the upper end of shaft 104. A toothed timing belt 126 extends around pulleys 120, 122 and 124 and rotates shafts 102 and 104 when motor 116 rotates pulley 120. Shafts 102 and 104, in turn, cause platen 100 to orbit or move in a circular pattern. The toothed belt and timing pulleys allow for perfect timing between shafts 102 and 104. Motor 116 is centered between pulleys 122 and 124 to eliminate the need for idlers on belt 126.

Disks 130 and 132 are mounted to the lower portions of shafts 102 and 104, respectively, to counterbalance the motion of platen 100. Weights 134 are attached to the disks and positioned opposite the step in the shaft to create the necessary counterbalance weight. Weights 134 may be made from nuts, bolts and washers and are therefore adjustable. Holes may be drilled in disks 130 and 132 to accommodate any number of bolts.

As can be understood from the structure described so far, platen 100 moves in two orbits, one created by the rotation of shafts 102 and 104 and the other created by the rotation of brace 70. This dual rotation simulates the motion of sanding by hand. Shafts 102 and 104 typically rotate at 3,000 to 12,000 revolutions per minute while shafts 72 and 74 typically rotate at approximately 200 revolutions per minute. In one aspect of the invention, the rotation of shafts 102 and 104 produce a first circular translational orbit speed of from one thousand to five thousand inches-per-minute. In an additional aspect of the invention, the rotation of shafts 72 and 74 result in a second circular translation orbit speed that has an average magnitude that is between 1/15 and 1/60 of that of the first speed. Shafts 102 and 104 may rotate in the same direction or in the opposite direction as shafts 72 and 74. Any structure capable of driving the platen and abrasive in one or more orbits may be used, such as the motor and drive shaft structure described above.

The invented sander may alternatively be constructed with only one orbit. One orbit allows for a smaller and less expensive machine.

Positioned between brace 70 and platen 100 are eight stabilizers 140. As best seen in FIGS. 1 and 5, each stabilizer is secured to brace 70 by a C-clamp 142. The C-clamp is made from two opposed, C-shaped parts, 144 and 146, one of which is welded to brace 70. A stabilizer is inserted between the two parts which are then bolted together by a bolt such as bolt 148.

As shown, the lower end of each stabilizer simply rests against the inner surface of platen 100. The pressure exerted by each stabilizer against platen 100 can be adjusted by elevator bolts 144. There is one elevator bolt for each stabilizer. Each elevator bolt is similar to a plunger and includes a threaded stud with a flat surface attached to one end. Each bolt is threaded through a tapped hole in brace 70. As seen in FIG. 5, a jam nut 146 and opposed nuts 148 are threaded onto the upper end of each elevator bolt. Loosening jam nut 146 allows for the elevator bolt to be tightened by nuts 148. Tightening the elevator bolt increases the pressure against stabilizer 140 which in turn increases the pressure against platen 100. When the desired pressure is obtained, jam nut 146 is tightened to secure the elevator bolts in position.

In this manner, the stabilizers are adjustable to level the platen, cause the platen to apply increased pressure at a certain point, or to compensate for wear. Additionally, the stabilizers maintain the platen level while still allowing it to move in two different orbits. In other words, because stabilizers 140 are made of rubber or synthetic rubber and are therefore partially deformable, platen 100 can remain level while moving in the orbit created by shafts 102 and 104 as well as in the orbit created by shafts 72 and 74.

As best seen in FIGS. 1, 5 and 6, a foam pad 150 is attached to the outer, bottom surface of platen 100. The pad is typically made from a deformable yet firm foam and is secured to the platen by an adhesive. For some applications, a sponge rubber or a rubber having a light durometer may be used.

An abrasive 152 is secured to the platen around foam 150. Clips 154 are used to secure the abrasive to the platen. Alternatively or additionally, the abrasive may be secured to the foam and platen by an adhesive. "Secured" means that the abrasive's motion is completely dependent on the platen's motion. Thus, when the platen moves the abrasive also moves.

The foam is positioned between the platen and the abrasive to provide a soft touch to prevent the abrasive's grit from scratching into a product too deeply. Without the foam, unwanted scratches would result from products that are not perfectly flat.

As shown in FIGS. 5 and 6, clips 154 are positioned on both sides of platen 100. A spring-biased rod 160 (shown best in FIGS. 4–6) is used to operate the clips on the back side of the platen. The rod includes a handle 162 and arms 164. When the handle is pushed down, the rod rotates and the arms contact the clips and cause them to open. The rod can then be locked in place by locking mechanism 166. The abrasive is then inserted between the clips and the platen. The clips close when the rod is released. In the preferred embodiment, the rod is secured to brace 70.

Figure 4:
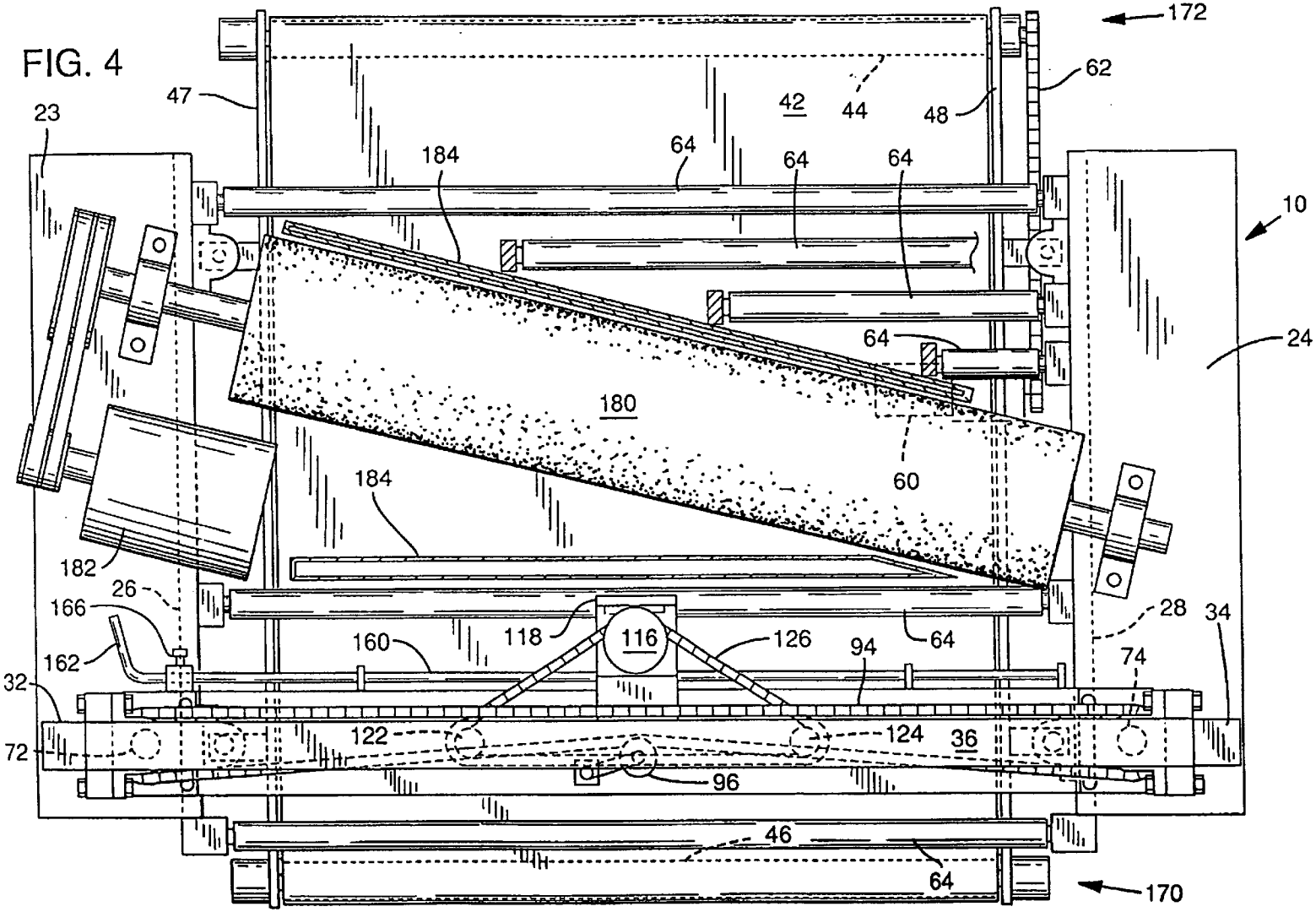
FIG. 4 is a top view of the preferred embodiment of the invention.

As seen in FIG. 4, the invented sander includes an upstream or front end 170 and a downstream or back end 172. Downstream from platen 100 is a rotating brush 180 positioned across conveyor belt 42. Brush 180 is supported by frame 16 and driven by a motor 182. Brush 180 removes any remaining streaks or scratches in products such as wood. Scratches removed by the brush are typically less than 0.0005-of-an-inch deep. Brush 180 is angled across conveyor belt 42 so that its bristles contact the wood product at an angle to any remaining cross-grain sanding patterns. Other embodiments of the invented sander may include two or more rotating brushes arranged at 90° relative to each other. Alternatively, the invented sander can be operated without any rotating brush.

In the preferred embodiment, a vacuum 184 (shown only in FIG. 4) is positioned upstream and downstream from brush 180 to remove any dust resulting from the sanding. Vacuum 184 may be mounted to frame 16 and extend above conveyor belt 42.

Figure 9:
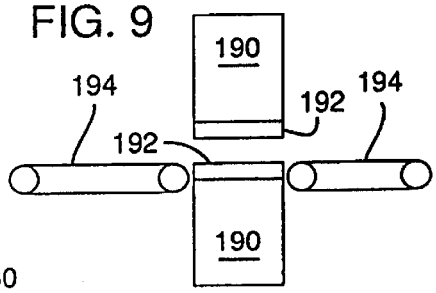
FIG. 9 is a simplified drawing of an embodiment of the invention having opposed orbiting platens.

FIG. 9 shows an alternative embodiment of the invented sander including two orbiting platens 190 positioned opposite each other. An abrasive 192 is secured to the opposed faces of each platen. A conveyor belt 194 feeds wood between the two platens, thereby allowing two surfaces of the wood to be abraded simultaneously. Alternatively, the platens may be arranged side-by-side in a row.

Operation

In operation conveyor belt 42 is lowered and a product such as a wood panel is placed thereon. The belt is then raised until the desired height is obtained. At this point, the wood is positioned between belt 42 and the first pinch roller 64.

The conveyor belt is then powered so that it feeds or drives the wood product toward platen 100. The area immediately beneath platen 100 may be thought of as an abrading area. As can be seen in FIGS. 5 and 6, the wood product, such as product 174 in FIGS. 5 and 6, is fed under platen 100 and abraded by abrasive 152. Abrasive 152 and platen 100 both move in at least one orbit, substantially eliminating all cross-grain sanding patterns.

The wood product is then fed past platen 100 where it contacts a second pinch roller. The wood product then contacts brush 180 and any remaining scratches or streaks are removed. The remaining pinch rollers 64 are supported by a brace (not shown) that extends over the conveyor belt. Those pinch rollers hold the wood product in position as it is conveyed under brush 180. The wood is finally emitted from the sander at downstream end 172.

Industrial Applicability

The invented sander is applicable in any situation where sanding patterns need to be removed from wood products. The invented sander is especially applicable for finish sanding applications such as desk and table tops, panels, doors and cabinets.

While the preferred embodiment and best mode for practicing the invention have been described, modifications and changes may be made thereto without departing from the spirit of the invention.

I claim:

1. A sander, comprising:

a frame;

a platen;

an abrasive associated with the platen;

a drive mechanism interconnecting the platen and the frame, configured to move the abrasive in a first motion superimposed on a second motion, where the first motion is an orbital motion and the second motion is a circular translational orbit; and a conveyor for conveying objects to be sanded in a feed direction toward the platen.

2. A sander, comprising:

a frame;

at least two platens;

an abrasive associated with each platen;

a drive mechanism interconnecting each platen and the frame, configured to move each abrasive in a first motion superimposed on a second motion, each platen superimposing an orbital motion on a circular translational orbit; and a conveyor for conveying objects to be sanded in a feed direction toward the platen.

3. A sander, comprising:

a frame;

a first platen;

an abrasive sheet secured to the platen;

a first drive shaft interconnecting the platen and the frame, configured to move the platen in an orbital motion;

a bearing mechanism interconnecting the platen and the first drive shaft, configured to permit the platen to move in a circular motion relative to the first drive shaft; and a conveyor for conveying objects to be sanded in a feed direction toward the platen.

4. The sander of claim 3, further comprising at least one additional platen, adjacent to the first platen, each additional platen having a drive shaft configured to move the additional platen in an orbital motion and a bearing mechanism configured to permit the platen to move in a circular motion relative to the drive shaft.

5. The sander of claim 4, where the platens are arranged side-by-side above the conveyor.

6. A sander, comprising:

a frame;

an abrasive sheet structure;

a drive mechanism interconnecting the frame and the abrasive sheet structure, configured to move the abrasive sheet structure in an orbital motion superimposed on a second motion; and a conveyor for conveying objects to be sanded in a feed direction toward the abrasive sheet structure;

where the second motion is a translational orbit.

* * * * *